United States Patent [19]

Salomon

[11] 4,253,251

[45] Mar. 3, 1981

[54] METHOD FOR MANUFACTURING A SKI BOOT

[75] Inventor: Georges P. J. Salomon, Annecy, France

[73] Assignee: Etablissements Francois Salomon et Fils, Annecy, France

[21] Appl. No.: 803,972

[22] Filed: Jun. 6, 1977

[30] Foreign Application Priority Data

Jun. 11, 1976 [FR] France ..... 76 17821

[51] Int. Cl.[3] ..... A43B 5/04

[52] U.S. Cl. ..... 36/119; 36/120

[58] Field of Search ..... 36/117, 118, 119, 120, 36/121

[56] References Cited

U.S. PATENT DOCUMENTS

| | | | |
|---|---|---|---|
| 3,522,668 | 8/1970 | Fesl | 36/119 |
| 3,775,872 | 12/1973 | Rathmell | 36/119 |
| 3,858,337 | 1/1975 | Vogel | 36/119 |
| 4,064,642 | 12/1977 | Vykukal et al. | 36/119 |

*Primary Examiner*—Patrick D. Lawson

*Attorney, Agent, or Firm*—Pollock, Vande Sande & Priddy

[57] ABSTRACT

The present invention relates to a ski boot including a foot-retaining system; the ski boot has a rigid shell; the metatarsal and instep retaining systems are assembled to the rigid shell by means of a base with which they are associated; the shell is molded onto the base and the assembly is achieved by means of tenon and mortise systems; the tension of the foot-retaining system of the ski boot is controlled by adjustable tensioning elements. The ski boot, and the method whereby it is manufactured, make it possible to automate the production process; more particularly, they facilitate the assembly of the foot-retaining system to the interior of the shell.

13 Claims, 38 Drawing Figures

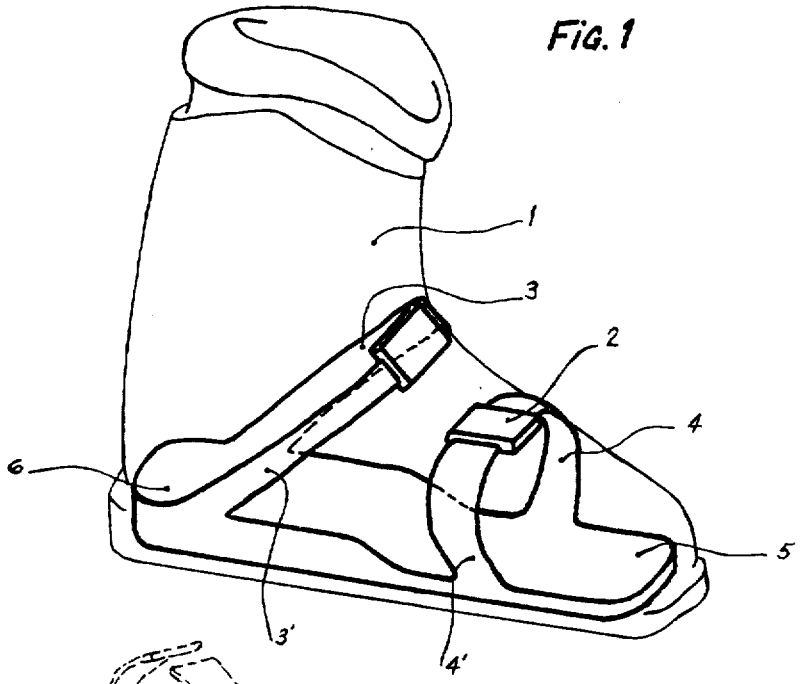
FIG. 1
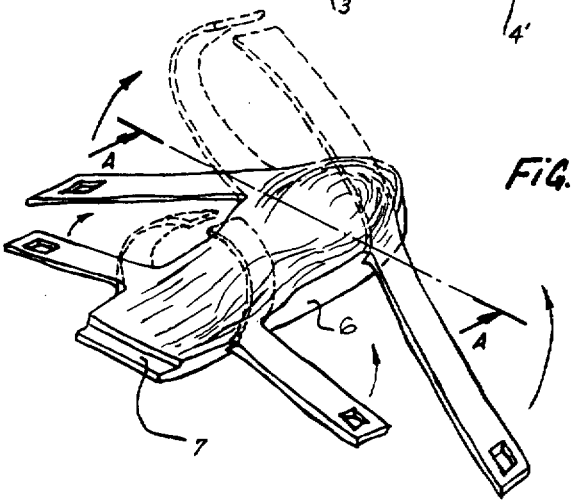
FIG. 2
FIG. 3
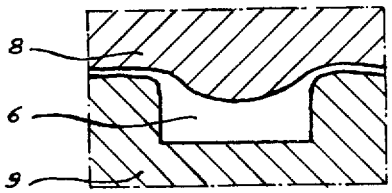

FIG. 8
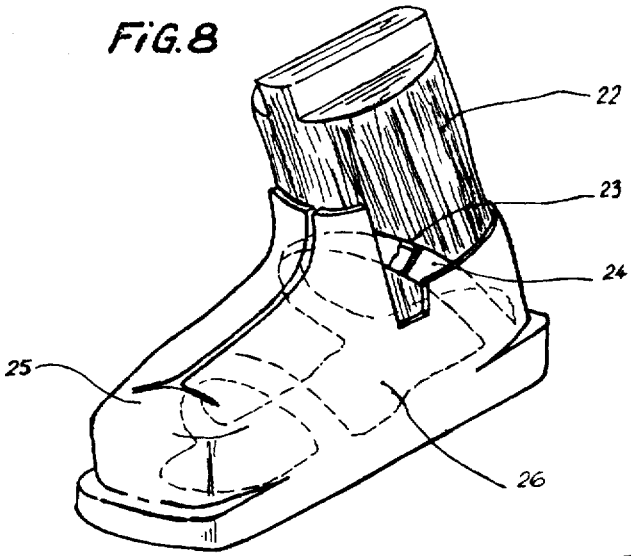
FIG. 10
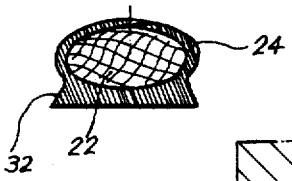
FIG. 9
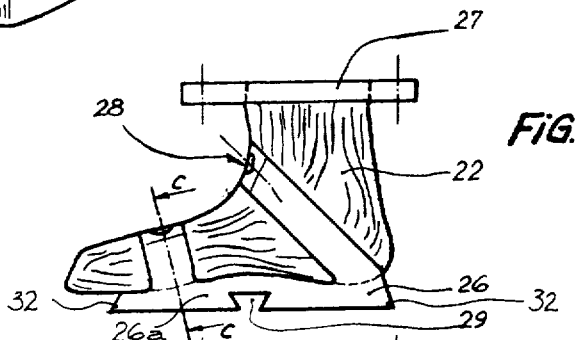
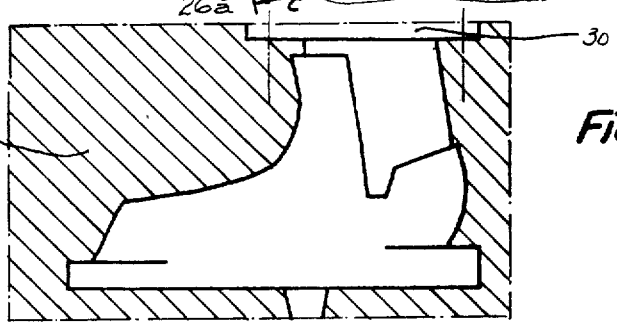
FIG. 11
FIG. 12
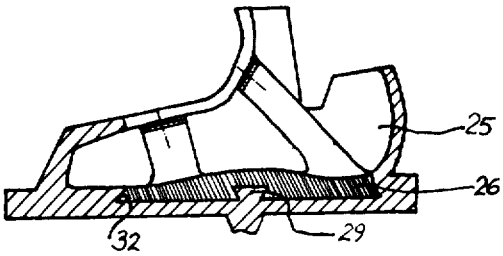

FIG. 25
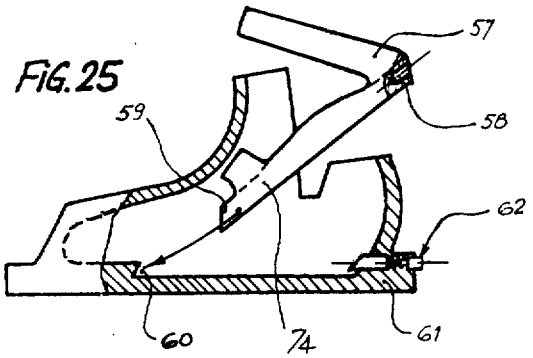
FIG. 26
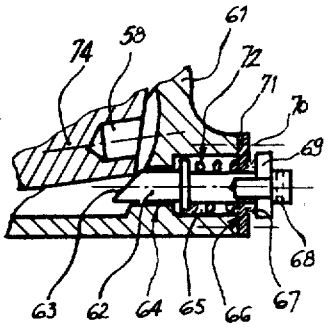
FIG. 27
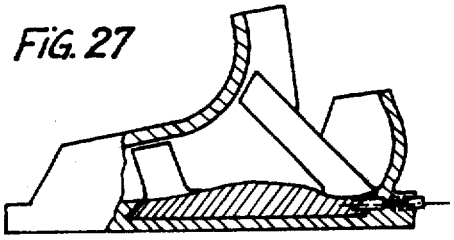
FIG. 28
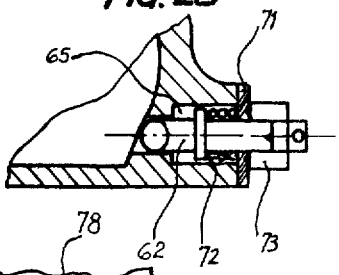
FIG. 29
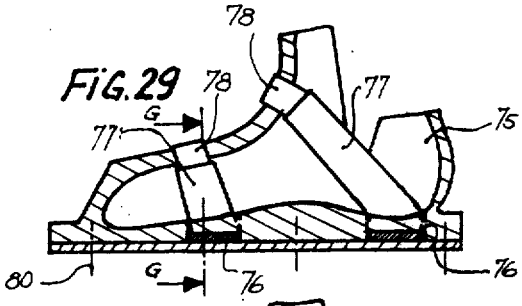
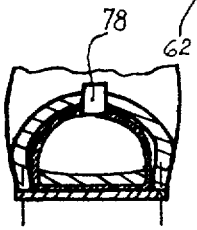
FIG. 30
FIG. 31
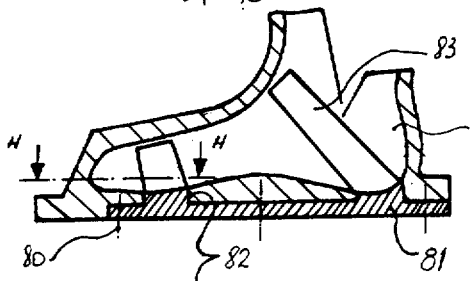
FIG. 32
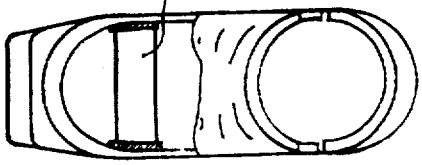

METHOD FOR MANUFACTURING A SKI BOOT

The present invention relates to a ski boot and to a method for manufacturing ski boots, more particularly to a ski boot comprising a rigid shell and a foot-retaining system located within the shell and surrounding at least a part of the foot; it also relates, more particularly, to a method for manufacturing a boot of this kind specifically designed to facilitate the attachment of the foot-retaining system to the interior of the rigid shell.

Ski boots comprising a foot-retaining system, especially securing means in the form of straps, are already known; these straps, secured to the interior of a rigid shell, provide satisfactory foot retention in the boot. Boots of this kind are described, for example, in: French Pat. Nos. 1,587,842 (KLEIN LAGEL); 2,045,321 (HEAD); 2,075,412 (LEDERER); and in U.S. Pat. Nos. 3,529,368 (ROSEMOUNT); 3,599,351 (ROSEMOUNT); and in applicant's copending U.S. patent applications Ser. Nos. 774,689 and 781,044, filed on Mar. 7 and Mar. 24, 1977, respectively. The straps constituting the foot-retaining system are preferably arranged between the rigid shell of the boot and a soft slipper, either at the instep or the metatarsus; they are usually secured to the interior of the shell, at the proper location, by means of rivets.

This design of a ski boot has its disadvantages, the main disadvantage being its high cost price, due to the fact that it is difficult to rivet the straps to the shell in areas difficult of access. Thus, it is difficult to reach the area in the boot where the instep straps are located (near the ankle), but it is even more difficult to reach the area where the metatarsal straps are located (near the front end of the boot). It is therefore obvious that riveting the straps inside the shell, at the respective locations, is not only an expensive operation, but it is also difficult to automate.

Still another problem arises if the straps break or the rivets pull out; here again, repairs are difficult to carry out and require the efforts of skilled tradesmen with special tools. Finally, it must be pointed out that the appearance of the boot is marred by rivets visible from the outside. Now, although a ski boot is a sports article designed to perform a specific function, there is an increasing demand, on the part of users, for a pleasing appearance. In other words, it is not enough for a manufacturer to produce a ski boot which performs its functions. Instead, the means used to this end must not spoil the appearance of the boot; in fact, they should even improve its appearance.

It is an object of the present invention to eliminate the foregong disadvantages. In other words, the invention relates to a novel ski boot comprising a foot-retaining system within a rigid shell, and to a novel method for manufacturing such a ski boot, the method permitting:

(a) automation and therefore mass production of a finished product of satisfactory quality;

(b) rapid and economical repair of the foot-retaining system in the event of failure;

(c) the design of boots of particularly pleasing external appearance.

In order to arrive at these results, and according to one main characteristic of the method according to the invention, the foot-retaining system is assembled to the rigid shell by means of a base.

It should be noted that, in this case, the expression "assembling the foot-retaining system to the rigid shell by means of a base" indicates that the base is involved, directly or indirectly, in securing the foot-retaining system to the rigid shell.

In certain embodiments, which will be described hereinafter in detail, the foot-retaining system is associated with the base, and the means used to assemble the foot-retaining system to the rigid shell act directly upon the base.

In other embodiments, the means act upon a complementary part fitted to the base. This part may be, for example, the straps supporting the instep. It should be noted that, even in this variant, the metatarsal-retaining system is assembled to the rigid shell by means of the base.

Finally, it will also be seen that the foot-retaining system may be assembled to the rigid shell by means of the base by allowing the latter to play a direct part in the assembly, i.e., by arranging the base and the foot-retaining system in a manner such that the foot is held to the plantar arch of the rigid shell.

Thus, the method according to the invention, which consists, as noted above, in assembling the foot-retaining system to the rigid shell by means of a base, may be applied in various ways. Before dealing with preferred embodiments, and before describing some practical examples in detail, it should be emphasized that the concept of the boot, and the concept of the method for manufacturing it, make it possible to achieve the purpose of the invention. Thus in the first place, the production of a base (which may, for example, be in the form of a sole) is a particularly simple operation, since it may be molded, cut-out, etc.; and in the second place, the design of the base makes it possible to arrange the attachments for the foot-retaining system, wherever they are, in directly accessible locations. It will be seen hereinafter, in the description of the various embodiments, that the means of assembly, and the arrangement thereof, under or in the shell, may vary. The main point to be remembered is that this additional part, namely the base, makes it possible to arrange the assembly areas at easily accessible locations. This means that the production of these ski boots may be automated without using complex tooling difficult to operate.

In the third place, it is obvious that, for the same reasons, the maintenance and repair of the boot is facilitated since the base makes it possible to use conveniently accessible attachment means. Furthermore, the base makes it possible, if desired, to assemble the foot-retaining system to the shell detachably, more particularly by a locking-unlocking system.

In the fourth place, the base makes it unnecessary to secure the foot-retaining system to the bottom of the shell by means such as rivets which are visible on the outside of the boot. Since the securing means are invisible, the appearance of the boot is improved.

As has already been pointed out, assembling the foot-retaining means to the rigid shell by means of the base may be achieved in various ways. The following are emphasized.

According to one characteristic of the invention, a unit consisting of the foot-retaining element and the base is produced and is assembled to the rigid shell by means of the base. This unit greatly facilitates automation of the method of manufacture according to the invention. It is obviously no problem to produce a rigid shell, a unit consisting of a foot-retaining element in the form of straps and a base in the form of a sole, and then to assemble them in directly accessible areas.

The foot-retaining unit may be a molding consisting of a base prolonged laterally by extensions, the ends of which are free and are intended to constitute the retaining system. The unit is completed by uniting the free ends of the extensions either directly or by means of adjustable tensioning elements. In the latter case, the rigid shell should allow the skier access to the tensioning elements from the outside.

The foot-retaining unit may also be made by cutting the base and the foot-retaining element out of a sheet of substantially constant thickness. Here again, the unit is completed by uniting the free ends of the lateral extensions of the blank which constitute the foot-retaining system (to be more precise, the straps constituting the means of attachment of the foot-retaining system).

It is also possible to secure the foot-retaining system to the base by means of assembly such as rivets, clips, welding, etc.

In order to assemble the foot-retaining unit to the rigid shell by means of the base, the rigid shell may, for example, be molded onto the base. It is also possible to arrange, in the lower part of the shell, an opening through which the foot-retaining unit may be introduced, whereupon the unit is secured to the shell by means of screws, clips, gluing, welding (ultrasonic or heat-welding), riveting, etc. Furthermore, if the shell has a plantar arch, apertures may be made in the arch, the foot-retaining system being installed with the free ends passing through the apertures, and the foot-retaining unit being appropriately secured to the shell. In this latter case, the foot-retaining unit is completed by uniting the free ends of the foot-retaining system, either directly or, as previously indicated, by tensioning means. The foot-retaining unit may also be secured to the rigid shell by utilizing the hinge pivots of a boot comprising a hinged part. In this case, it is not the base of the foot-retaining unit that it assembled directly to the rigid shell, but a complementary part (for example, the means of attachment in the form of straps constituting the instep retaining system) is assembled to the hinge pivots. However, even in this case, the metatarsal retaining system is best assembled to the rigid shell by means of the base with which it is associated. The foot-retaining unit may also be assembled to the rigid shell by making the latter in the form of two half-shells enclosing the base. It may also be assembled detachably to the rigid shell by means of a locking-unlocking system.

According to another main characteristic of the invention, it is also possible to assemble the foot-retaining unit to the rigid shell, by means of a base, in the following manner: Arranged in the plantar arch of the shell is a transverse recess and two lateral apertures passing through the thickness of the plantar arch. The foot-retaining system (in this case consisting of attachment means in the form of straps) is partly introduced into the lateral apertures and the transverse recess. Finally, the base is secured, under the plantar arch, to the rigid shell in such a manner as to enclose the foot-retaining system introduced into the transverse recess.

It is emphasized that, in this embodiment, it is no longer necessary to produce a distinct foot-retaining unit, consisting of a foot-retaining system and a base, prior to assembly into the rigid shell. In this embodiment, the rigid shell, the foot-retaining system, and the base are simultaneously secured when the base is secured under the plantar arch. It should also be noted that the base may be designed to assure that the boot is sealed in spite of the apertures passing through the thickness of the plantar arch.

No description will be given at this time of the characteristic structures of ski boots manufactured according to the methods indicated above, on the one hand because they may be deduced directly from the description given of the methods of manufacture and, on the other hand because the characteristics will be defined in the detailed descriptions of the embodiments of the invention illustrated, without in any way restricting the invention, in the drawings attached hereto, wherein:

FIG. 1 shows a foot-retaining element produced according to the method of the present invention;

FIG. 2 shows a foot-retaining element in the form of a molding;

FIG. 3 is a section, along line A—A of the foot-retaining element according to FIG. 2, still in its mould;

FIG. 8 is a perspective view of the bottom of the shell molded onto a core upon which is mounted a foot-retaining element;

FIG. 9 is a side elevation of the core and foot-retaining element shown in FIG. 8;

FIG. 10 shows a section, along line C—C, of the foot-retaining element in FIG. 9, showing the arrangement of the means of attachment in the form of straps on the core so that it may be correctly located in the mold;

FIG. 11 is a cross section through one half of a mold designed to produce the bottom of the shell of a ski boot;

FIG. 12 shows a longitudinal section through a ski-boot-shell bottom molded onto a foot-retaining element;

Figure 14:
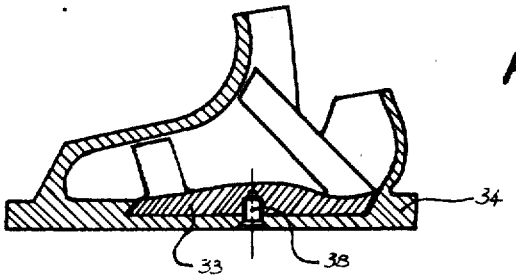
FIG. 14 shows a longitudinal section through the foot-retaining element in FIG. 13 secured to the inside of the shell by means of a screw underneath the sole.
Figure 15:
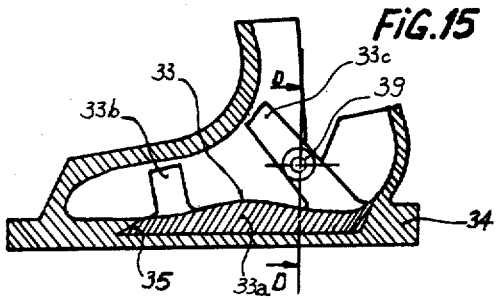
FIG. 15 shows a longitudinal section through the foot-retaining element, after it has been introduced as shown in FIG. 13, the element being secured to the shell laterally by the hinge pivots of the boot.
Figure 16:
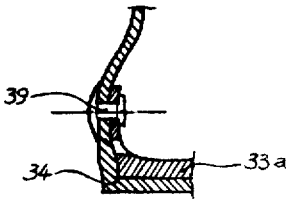
FIG. 16 is a section taken along line D—D of FIG. 15.
Figure 19:
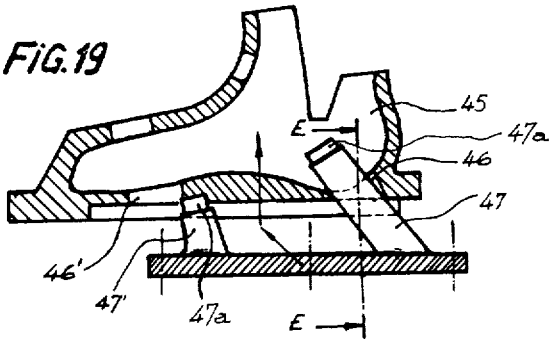
Figure 20:
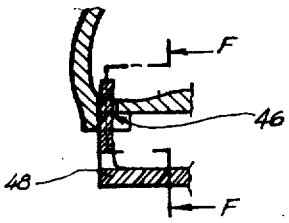
Figure 21:
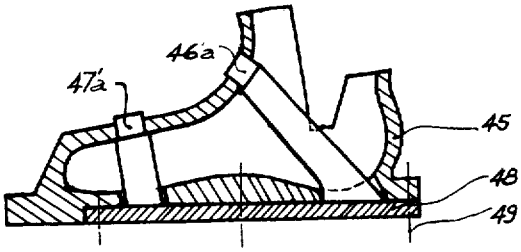
Figure 22:
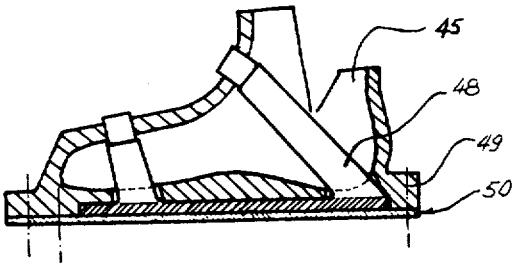
Figure 23:
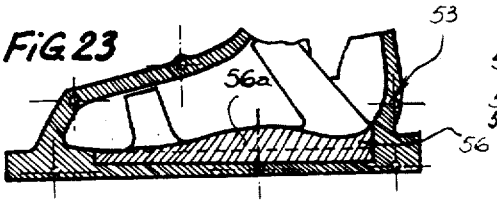
Figure 24:
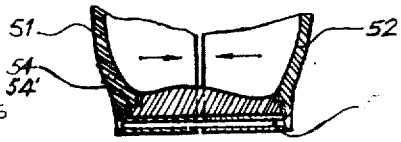
Figure 33:
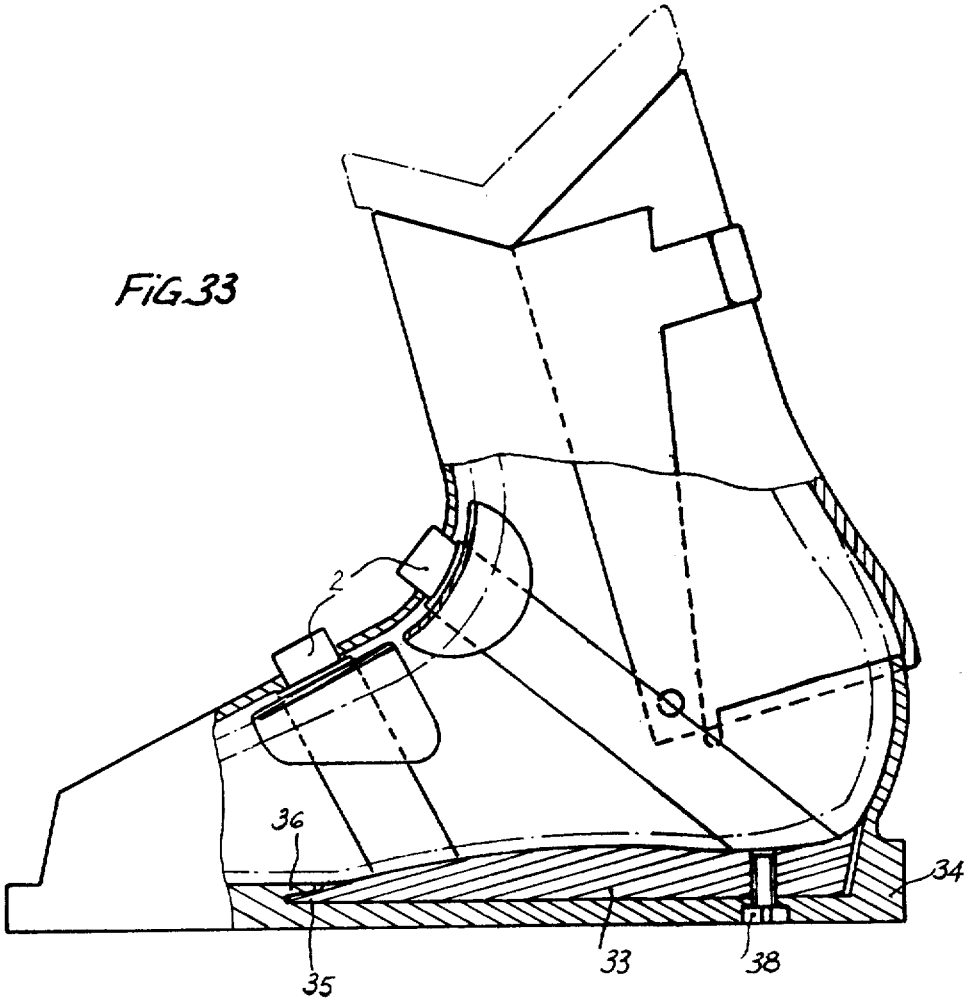
Figure 34:
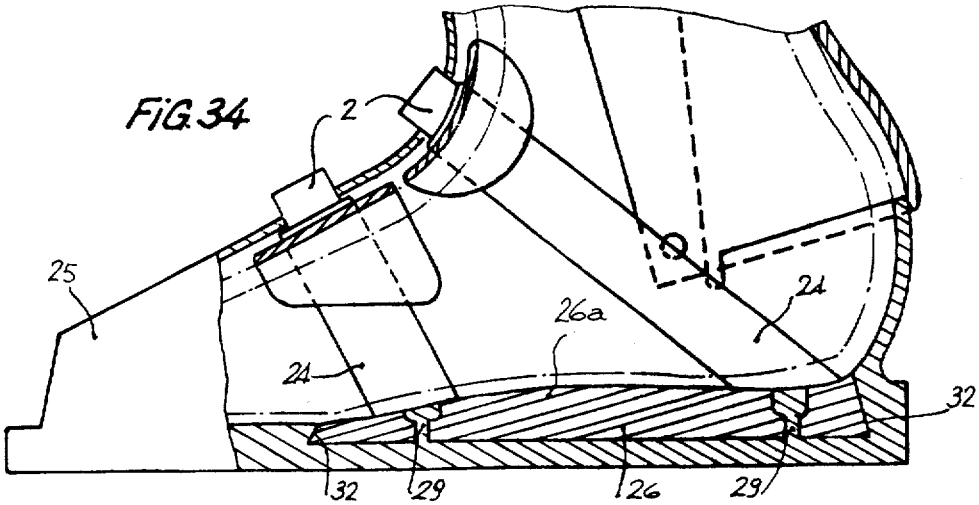
Figure 35:
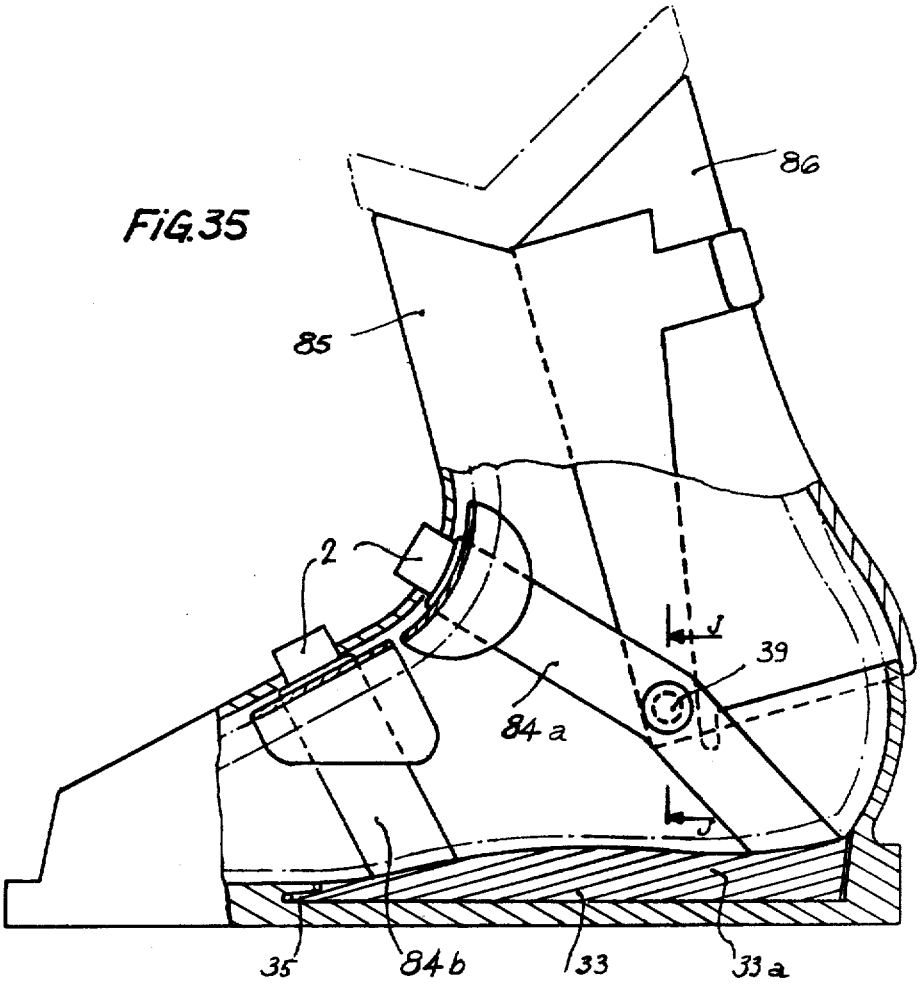
Figure 36:
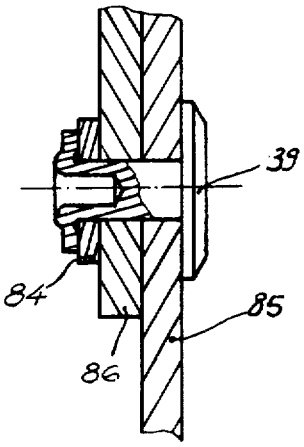
Figure 37:
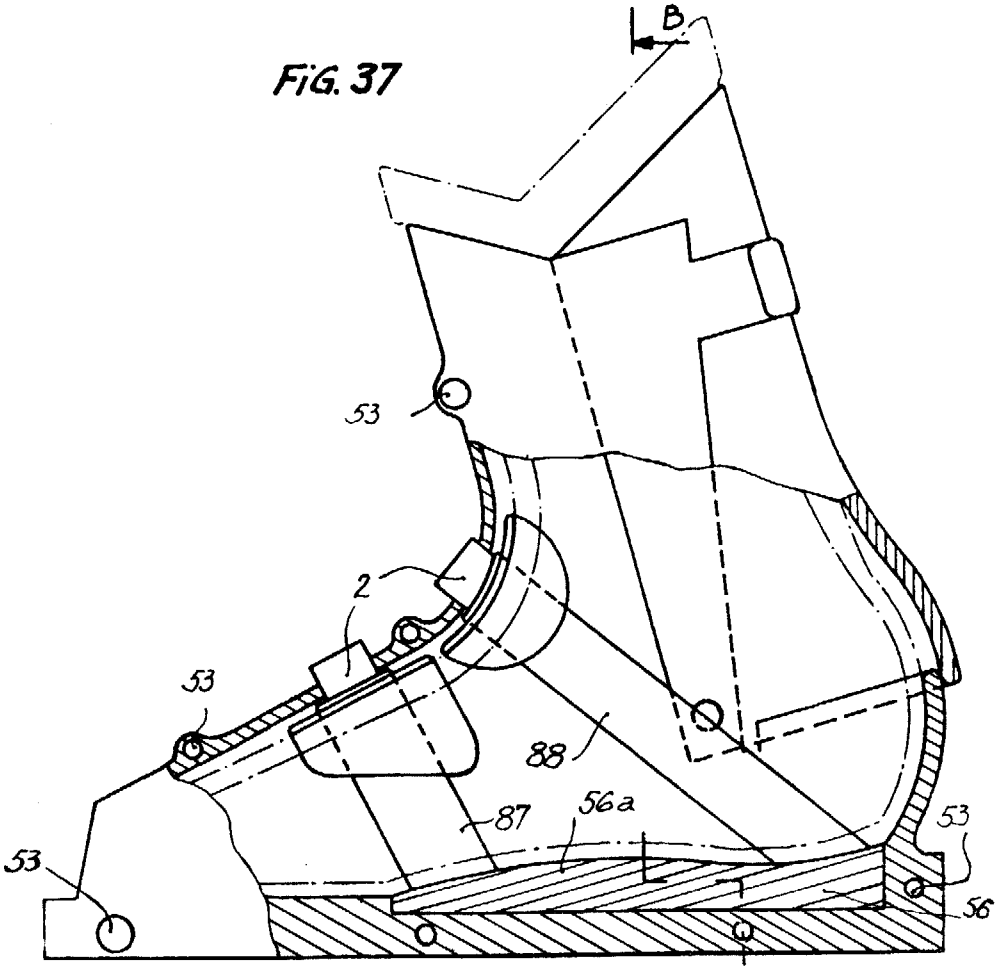
Figure 38:
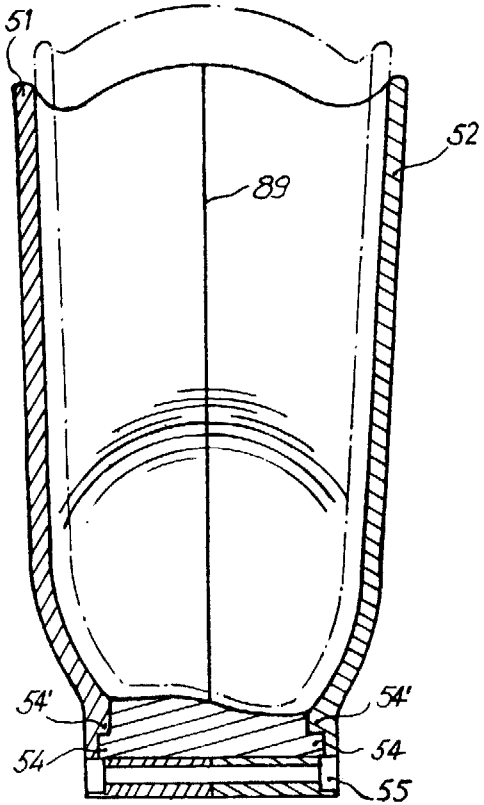

FIGS. 19, 20 and 21 show cross sections of a variant of the method of locating the foot-retaining element in a shell, in which the straps of the foot-retaining system are introduced into apertures located in the plantar arch of the shell and the base is applied to the bottom of the sole thereof, FIG. 20 being a cross section along line E—E of FIG. 19 while FIG. 19 is a longitudinal section along line F—F of FIG. 20;

FIG. 22 shows a longitudinal section of another method of assembly similar to that shown in FIG. 21, in which the foot-retaining element is held to the shell by means of an additional sole placed under the base and secured to the lower part of the shell;

FIGS. 23 and 24 are longitudinal and cross sections, respectively, of another method of locating and assembling a foot-retaining element between two half-shells which fit and hold the base;

FIGS. 25,26,27 and 28 are longitudinal sections of another method of assembling the foot-retaining element to the rigid shell, making it possible to detach the foot-retaining element from the shell at will;

FIGS. 29 and 30 are longitudinal and cross sections, respectively, of another method of assembling the foot-retaining system to the shell by means of a base, FIG. 30 being a cross section along line G—G of FIG. 29;

FIGS. 31 and 32 are respectively a longitudinal section and a partly broken away view of the top, along line H—H, of another method of assembling the foot-retaining element to the shell;

FIG. 33 is a detailed longitudinal section of a method of assembly of the type illustrated in FIG. 14, showing the tensioning elements of the means of attachment, in the form of straps, of the foot-retaining system;

FIG. 34 shows a detailed longitudinal section of a method of assembly of the type illustrated in FIG. 12;

FIG. 35 is a detailed view, in longitudinal section, of a method of assembly of the type illustrated in FIGS. 15 and 16;

FIG. 36 is a cross-section along line J—J of FIG. 35;

FIG. 37 is a detailed view, in longitudinal section, of a method of assembly of the type illustrated in FIGS. 23 and 24; and FIG. 38 is an end view thereof.

FIG. 1 illustrates a ski boot 1, assumed to be transparent, equipped with a foot-retaining element 6 consisting of a base 5 (for example an inner sole or a part of an inner sole) and of a foot-retaining system having means of attachment such as instep straps 3,3' and metatarsal straps 4,4', the means of attachment being fitted with tightening means 2.

FIG. 2 shows a foot-retaining element 6 in which the straps and the base are a one-piece molding. The base has a sort of tenon 7 which is a part of the means of assembly to the shell. In order to make molding possible, the ends of the straps are free and the straps are subsequently united to form the foot-retaining system, by tightening devices as shown in FIG. 1.

FIG. 3 is a cross section of the upper 8 and lower 9 mold halves used to produce foot-retaining element 6.

Figure 4:
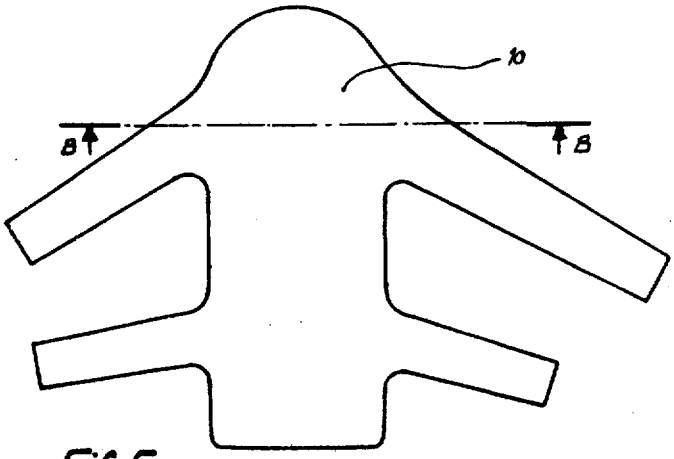
FIG. 4 is a plan view of a foot-retaining element in the form of a stamped-out blank.
Figure 5:
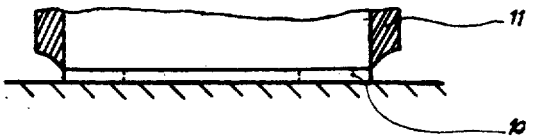
FIG. 5 is a section along line B—B in FIG. 4 showing the blank of substantially constant thickness.

FIG. 4 illustrates a foot-retaining element 10, the base and straps of which have been stamped (as shown in FIG. 5) out of a piece of material (a plastic, for example) of constant thickness. This foot-retaining element is particularly suitable for the boot illustrated in FIG. 22.

Figure 6:
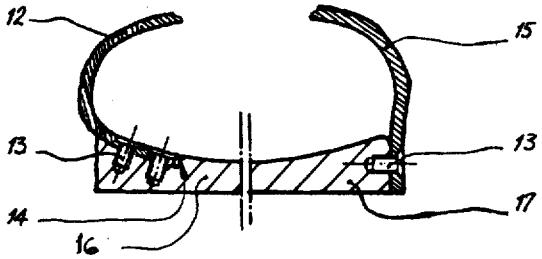
FIG. 6 shows two half-sections, at the level of the means of attachment, in the form of straps constituting the foot-retaining system, showing two different ways of securing the means of attachment to the base.

FIG. 6 shows two half-sections of the straps constituting the foot-retaining system at the point of attachment to the sole or base, the method of attachment depending upon the shape and nature of the materials used. In the first half-section, strap 12 is secured by screws 13, by rivets, by gluing, or by welding, etc. in a recess 14 in sole 16. In the second half-section, strap 15 is secured by screws 13, by rivets, by gluing, or by welding, etc., to the lateral surface of sole 17.

Figure 7:
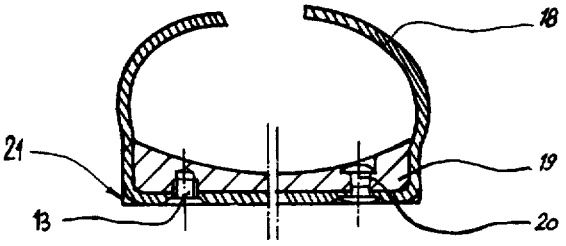
FIG. 7 shows two half-sections, at the level of the means of attachment, in the form of straps constituting the foot-retaining system, showing two other different ways of securing the means of attachment to the bottom of the base.

FIG. 7 shows two methods of securing a strap 18 running in a groove 21, equal in width to the strap, in the bottom surface of a base 19 in the form of a sole; the strap is secured to the base by means of screws 13, by rivets 20, or by gluing, welding, etc.

FIG. 8 shows, in perspective, the bottom 25 of the shell of a ski boot moulded around a core 22 comprising grooves 23 accommodating straps 24 of foot-retaining element 26.

FIGS. 9 and 10 illustrate the core 22 upon which foot-retaining element 26 is mounted, the core being equipped with a plate 27 locating it in the mold. Straps 24 overlap and are secured in the grooves by detachable means 28. Base 26*a* has a mortise 29 and a dovetailed tenon which cooperate to assure that the shell is securely moulded to the foot-retaining element.

FIG. 11 illustrates the mold 31 for the bottom of the shell with a recess 30 for locating the core.

FIG. 12 is a section through the bottom 25 of the shell molded, and held by tenons and mortises 29,32, to foot-retaining element 26.

Figure 13:
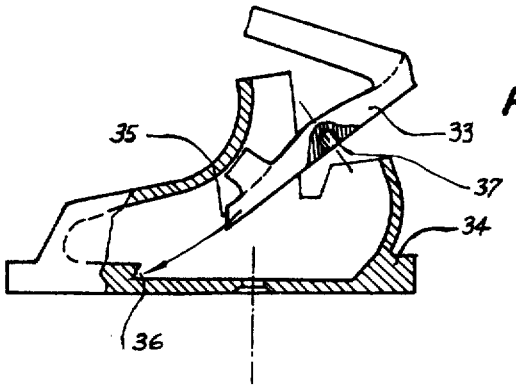
FIG. 13 shows a longitudinal section of a method of locating a foot-retaining element in a shell, the element being adapted to be removed.

FIGS. 13 and 14 show a method of locating a foot-retaining element 33 in a shell 34 by fitting, the base being equipped with a threaded hole 37 and a tenon 35. The latter enters dovetail 36 in the shell and cooperates with a screw 38 inserted into hole 37 for the purpose of assembling foot-retaining element 38 to shell 34.

FIGS. 15 and 16 show another method of assembling foot-retaining element 33 and shell 34; the method of locating by fitting is identical with that shown in FIG. 13. The foot-retaining element is assembled to the shell at the location of axes 39 which also serve to hinge the boot upper to the shell. Metatarsal foot-retaining system 33*b*, in this case, is assembled to the shell by means of a tenon 35, base 33*a*, and instep-retaining system 33*c* which is integral with base 33*a*; metatarsal retaining system 33*b* is thus assembled to the shell by means of base 33*a*.

Figure 17:
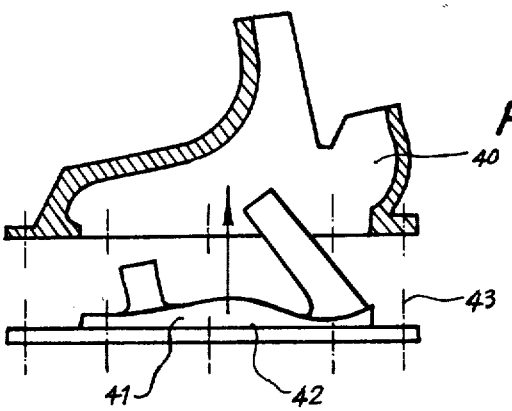
FIG. 17 shows a longitudinal section of another method of locating the foot-retaining element inside the shell of a ski boot (from below)
Figure 18:
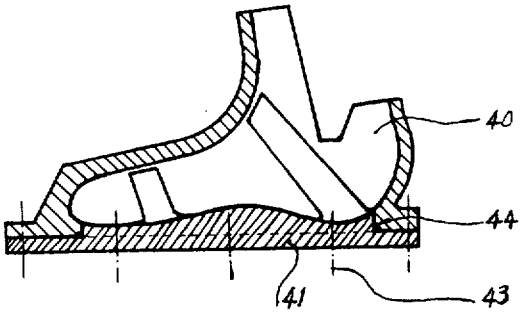
FIG. 18 shows a longitudinal section through the foot-retaining element in FIG. 17 secured to the shell from underneath the shell.

FIGS. 17 and 18 illustrate another method of locating (from below the shell) foot-retaining element 41 in a shell 40 open at the bottom. In this case, foot-retaining element 41 acts as the insole (plantar arch) and as the outer sole, surface 42 thereof being applied and secured to the lower part of shell 40 by securing means 43; for the purpose of obtaining a hermetically sealed assembly, a seal 44 is fitted to surface 42.

FIGS. 19, 20 and 21 represent a variant of the locating means illustrated in the preceding figures, the method of introducing the foot-retaining element into the shell being similar. In this case, straps 47,47' constituting the foot-retaining system of foot-retaining element 48, pass through apertures 46,46' in shell 45. Foot-retaining element 48 is then applied and secured to the lower part of the shell by securing means 49.

In this embodiment, the ends of the system for retaining the metatarsus and the body of the foot (the ends of the means of attachment in the form of straps) are left free to allow them to be passed through apertures 46,46'; they are then united, inside the shell, by tensioning elements 47*a*,47*b* on the means of attachment, the tensioning means being accessible through windows arranged in the shell (see FIGS. 33,34).

FIG. 22 shows another variant of the locating method illustrated in FIG. 19; in this case, the base of foot-retaining element 48 is placed in a housing (or recess) located under the lower part of shell 45 and held by a plate 50, acting as the outer sole, assembled to the shell by securing means 49.

FIGS. 23 and 24 shows a method of locating and assembling which differs from all of the foregoing in that a foot-retaining element 56, comprising a base 56*a* having lateral tenons 54, is accommodated in two half-shells 51,52 which are united and comprise grooves 54' accommodating tenons 54 of the base. When the two half-shells are assembled by means of threaded rods 55 located in holes 53 in the half-shells, they grip and secure the foot-retaining element.

FIGS. 25,26 and 27 also represent a method of locating foot-retaining element 37 in a shell 61 by fitting, but in this case the foot-retaining element is assembled detachably to the shell by means of a locking system 62 which can be unlocked and which is located in the heel of the shell. Tenon 59 on base 74 fits into dove-tail 60 in the shell, after which base 74 is caused to bear upon ramp 62 of the locking system. This causes the catch to slide in guide 64 and to compress spring 72 in cage 65. The other end of the spring bears against a stop-plate 71 secured to the shell by means of assembly 70. The catch is kept in the locked position by spring 72 and by lugs 67 on a crosspiece 69 which fits into recesses 66 in plate 71 and which thus prevents the catch from rotating about its longitudinal axis.

FIG. 28 shows the catch in the unlocked position in which it is held back by a crosspiece, lugs 67 of which now fit into cavities 66 in plate 70. This allows the catch to be rotated about its longitudinal axis in order to release the base of the shell.

FIGS. 29 and 30 illustrate a variant of the boot in which the underside of shell 75 (the underside of the plantar arch) is equipped with two transverse cavities or housings 76. The plantar arch also has two lateral apertures which pass through the thickness thereof, the apertures being designed to allow two straps (or means of attachment) 77,77' to be introduced into the shell, the straps fitting into each other, being mounted in transverse cavities 76, and being united by a tensioning means 78 controlled externally of the shell. The foot-retaining system, comprising two straps 77,77', is secured to the shell by means of a separate base 79 secured to the bottom of the shell by means 80.

FIGS. 31 and 32 illustrate a method of locating a foot-retaining element 81 by the bottom of shell 75 which contains transverse apertures 82 which allow straps 83 to be introduced, even if the ends thereof are not free. The element is secured to the shell by means 80.

FIG. 33 is a detailed view of a ski boot according to the invention. The assembly of the foot-retaining system and the shell is of the type described in connection with FIG. 14. Base 33 is secured to shell 34 by a sort of tenon 35 in the base which snaps into a corresponding mortise in the shell. The base is held at the rear by a screw 38. The means 2 of fastening and adjusting the straps of the foot-retaining system are also shown. These means secure the straps to the inside of the shell, but may be adjusted externally of the boot.

FIG. 34 is a detailed representation of a boot made by a variant of the method according to the invention described in connection with FIG. 12. This figure shows the elements 2 which tension the straps and which secure them to the inside of the shell, but which are controlled from the outside of the boot.

FIGS. 35 and 36 show in detail a boot made by a variant of the method according to the invention described in connection with FIGS. 15 and 16. Use is made of pivots 39 and hinged part 86 of shell 85 to assemble straps 84*a* and base 33 to the shell; straps 84*b* of the metatarsal retaining system are mounted on the base. The front of the base is secured by a catch 35 as described hereinbefore. Tensioning means 2 are shown as before.

FIGS. 37 and 38 show in detail the boot produced in accordance with a variant of the method of location described in connection with FIGS. 23 and 24. The figures show tensioning means 2 securing straps 87,88 to the inside of two half-shells 51,52 assembled along a medium plane 89 by means of threaded rods 55 running in holes 53. As before, the tensioning means are controlled from the outside of the boot.

What is claimed is:

1. A ski boot comprising (a) a rigid shell;

(b) a foot-retaining system located entirely within said shell, comprising (i) a base;

(ii) at least one strap attachment means assembled to said base and partially surrounding the foot to be retained;

(iii) means for tensioning said strap attachment means on the foot, said tensioning means being accessible from the outside of said shell; and (iv) means for assembling said base to the lower portion of the interior of said shell.

2. A ski boot comprising (a) a rigid shell;

(b) a foot-retaining element located entirely within said rigid shell and designed to surround at least a part of the foot;

(c) said foot retaining element comprising (i) a base in the form of a sole designed to enable the foot retaining element to be assembled to the lower part of the interior of the rigid shell; and (ii) attachment means in the form of straps, each fixedly mounted on said base and at least partly surrounding the top and/or the instep of the skier's foot.

3. A ski boot according to claim 2, wherein said foot-retaining element further comprises means for tensioning said straps, said tensioning means being accessible from the exterior of the boot.

4. A ski boot according to claim 2, in which said foot-retaining element is obtained by molding-on, whereby said foot-retaining system is associated directly with said base.

5. A ski boot according to claim 2, which foot-retaining element is a stamping, whereby said foot-retaining system is associated directly with said base.

6. A ski boot according to claim 2, wherein said attachment means in the form of straps is associated with said base by assembly means.

7. A ski boot according to claim 2, wherein said foot-retaining unit is assembled to said rigid shell by moulding-on.

8. A ski boot according to claim 2, wherein the lower part of said shell includes an opening for the introduction of said foot-retaining unit, the base thereof being attached to said shell by securing means, said shell being provided with a recess designed to accommodate said base, and said securing means including a plate constituting the sole and enclosing said base in said recess.

9. A ski boot according to claim 2, wherein said shell includes a plantar arch through which apertures pass, said attachment means in the form of straps being engaged through said apertures, and the base thereof being attached to said shell by securing means, said shell being provided with a recess designed to accommodate said base, and said securing means including a plate constituting the sole and enclosing said base in said recess.

10. A ski boot according to claim 2, wherein said shell includes a part hinged about a hinge pivot, said foot-retaining unit being assembled to said shell on a level with said hinge pivot.

11. A ski boot according to claim 2, wherein said shell is in the form of two half-shells; said base being clamped between said two half-shells.

12. A ski boot according to claim 2, wherein said foot-retaining unit is assembled detachably to said shell by means of a locking system which may be unlocked.

13. A ski boot according to claim 2, in which said rigid shell includes a plantar arch having a transverse recess and two lateral apertures designed to accommodate in part said attachment means in the form of straps, the latter being assembled to said shell by means of said base which is secured under the plantar arch and which encloses the part of the attachment means introduced into said recess.

* * * * *